US005192146A

United States Patent [19]

Landsberg

[11] Patent Number: 5,192,146

[45] Date of Patent: Mar. 9, 1993

[54] OPEN SEAM FRICTION ROCK STABILIZER

[75] Inventor: Thomas J. Landsberg, Princeton, N.J.

[73] Assignee: Simmons-Rand Company, Bristol, Va.

[21] Appl. No.: 753,106

[22] Filed: Aug. 30, 1991

[51] Int. Cl.[5] ..... E21D 21/00

[52] U.S. Cl. ..... 405/259.1; 405/259.3; 405/302.1

[58] Field of Search ..... 405/259.1, 259.3, 259.5, 405/259.6, 302.1; 411/57, 60, 61

[56] References Cited

U.S. PATENT DOCUMENTS

| | | | |
|---|---|---|---|
| Re. 30,256 | 4/1980 | Scott | 405/259 |
| 4,012,913 | 3/1977 | Scott | 61/45 |
| 4,284,379 | 8/1981 | Chaiko | 405/259.3 X |
| 4,316,677 | 2/1982 | Ciavatta | 405/259 |
| 4,322,183 | 3/1982 | Ciavatta | 405/261 |
| 4,472,087 | 9/1984 | Elders | 405/259.3 |
| 4,634,317 | 1/1987 | Skogberg et al. | 405/259.3 |
| 4,666,345 | 5/1987 | Seegmiller | 405/259.1 X |
| 4,826,358 | 4/1989 | Brustrom | 405/259.1 |

FOREIGN PATENT DOCUMENTS 514153 10/1979 Australia .

*Primary Examiner*—David H. Corbin
*Attorney, Agent, or Firm*—John J. Selko

[57] ABSTRACT

An open seam friction rock stabilizer having a compressible body with portions alternately in contact with and not in contact with borehole wall, the contacting portions being separated by an angle between 70 degrees and 150 degrees.

11 Claims, 5 Drawing Sheets

OPEN SEAM FRICTION ROCK STABILIZER

BACKGROUND OF THE INVENTION

This invention relates generally to friction rock stabilizers and particularly to friction rock stabilizers for forced insertion thereof into an undersized bore in an earth structure, such as a mine roof or wall.

One type of friction rock stabilizer uses a slit along its length to provide compressibility. Such stabilizers are sold by Simmons-Rand Company under its registered trademark Split Set.

The use of Split Set stabilizers to stabilize the rock layers in the roofs and walls of mines tunnels and other excavations is well known. In application, these devices provide the benefit of relatively easy installation and a tight grip, which grows stronger with time and as rock shifts. A concern associated with these Split Set stabilizers is that their weight and bulk contribute to manufacturing and shipping costs.

The foregoing illustrates limitations known to exist in present Split Set stabilizers. Thus, it is apparent that it would be advantageous to provide an alternative directed to overcoming one or more of the limitations set forth above.

Accordingly, a suitable alternative is provided including features more fully disclosed hereinafter.

SUMMARY OF THE INVENTION

In one aspect of the present invention this is accomplished by providing an open seam stabilizer that has a body that urges a plurality of friction surfaces against the wall of the borehole, while the remainder of the body between the friction surfaces is substantially in noncontact with the borehole. The friction surfaces are spaced apart from each other at an angle between 70 degrees and 150 degrees, as measured around a center axis of the borehole. The portion of the body not in contact with the borehole can be arcuate or straight line in cross section. In addition, the body portion between two friction surfaces adjacent the open seam can be eliminated altogether.

According to a second embodiment, the body is V-form in cross section, having a pair of arms angularly joined at a backbone portion opposite the open seam, the arms and backbone terminating in friction surfaces.

The foregoing and other aspects will become apparent from the following detailed description of the invention when considered in conjunction with the accompanying drawing figures.

BRIEF DESCRIPTION OF THE DRAWING FIGURES

FIG. 1 is a perspective view of a prior art Split Set stabilizer.

FIGS. 2 and 2A are perspective views of bearing plates for use with Split Set stabilizers FIG. 3 is a cross sectional view of an installed prior art Split Set stabilizer, showing an example of the points of friction with the borehole, and portions of the body in noncontact with the borehole, due to irregularities that may occur in either the borehole diameter or in the stabilizer body dimensions, or in both.

DETAILED DESCRIPTION

Figure 1:
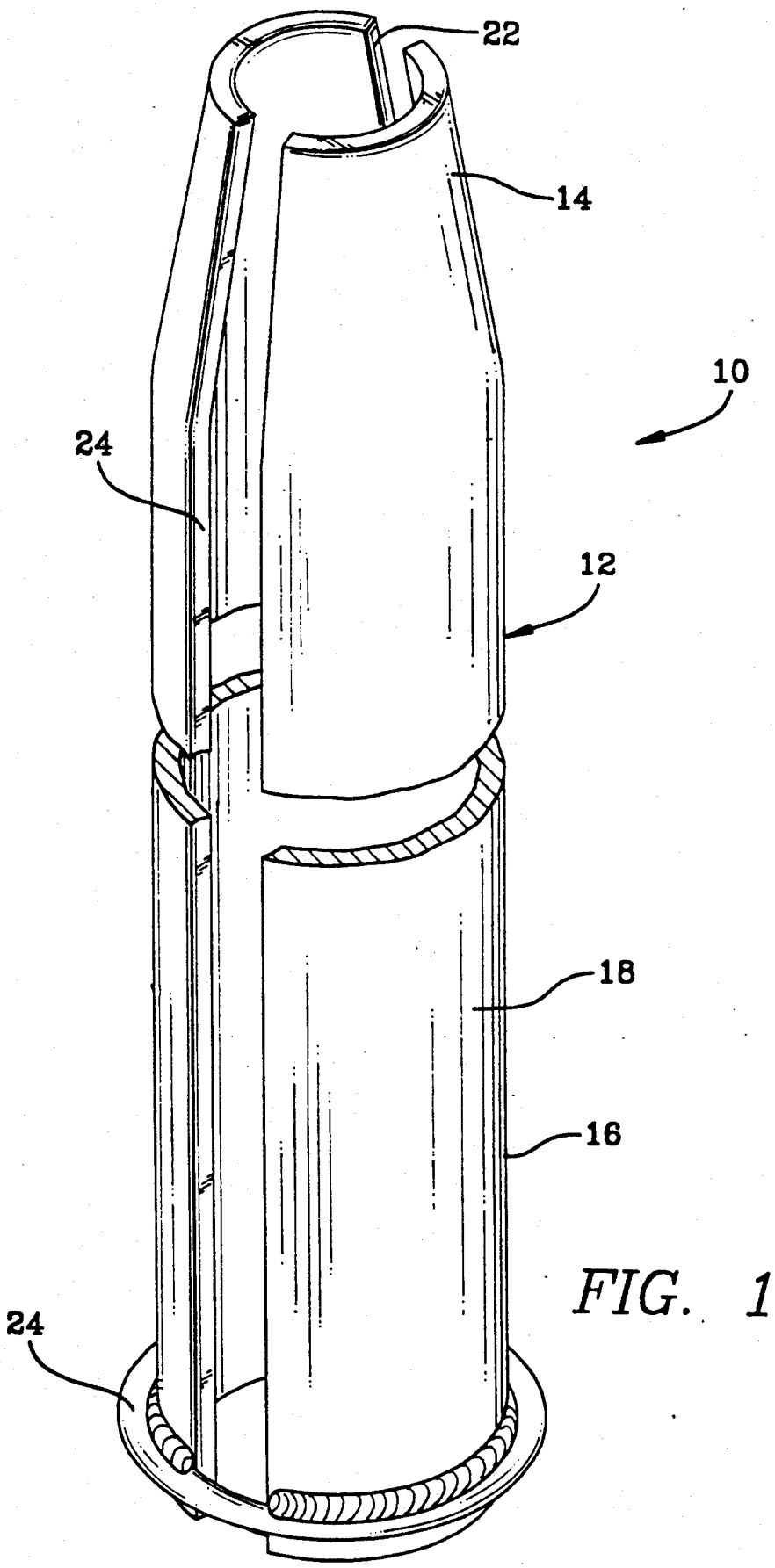
Figure 2:
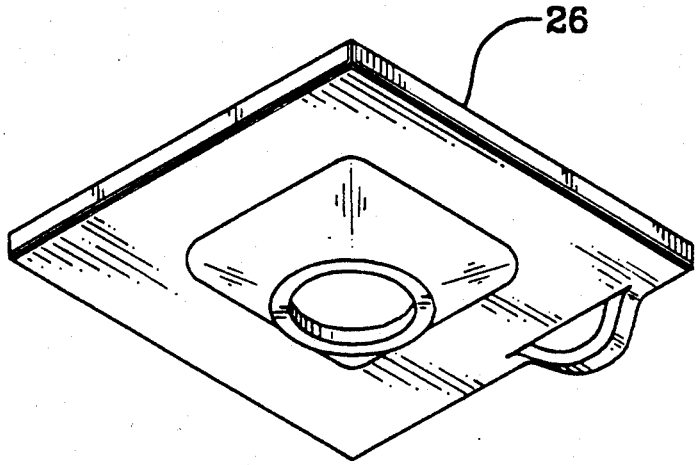
Figure 2A:
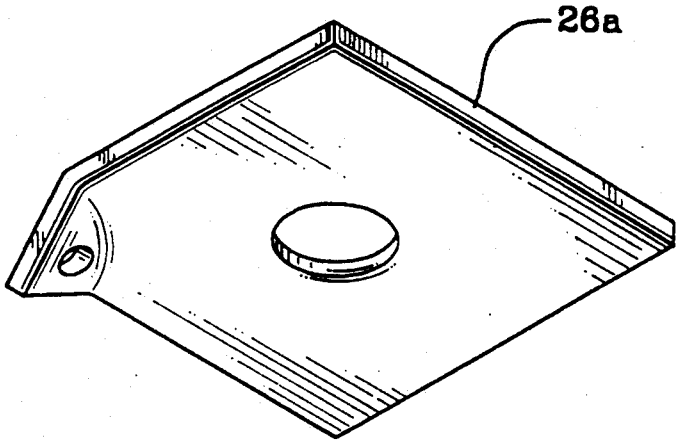

Referring to FIG. 1, there is shown a typical Split Set stabilizer 10. As can be seen in the illustration, Split Set stabilizer 10 comprises a hollow cylindrical tubular body 12, having a tapered top end 14, a bottom end 16, a shank 18 extending between top end 14 and bottom end 16, and a slit 20 extending the length of body 12. Top end 14 is tapered to facilitate insertion into a slightly smaller borehole (not shown). A second slit 22 in end 14 facilitates the manufacture of tapered end 14, as is well known. Bottom end 16 of said body 12 has welded thereto a ring flange 24 for supporting a bearing plate 26 or the like (FIG. 2).

When Split Set stabilizer 10 is installed, a borehole (not shown) is drilled that is substantially circular in cross section. As used herein, the term "cross section" or "horizontal cross section" refers to a view taken on a plane that is transverse to, and perpendicular to, the elongated axis of the borehole.

The diameter of the borehole is slightly smaller than the diameter of the cylindrical body 12. Tapered top end 14 is then fit into the mouth of a borehole, and the length of body 12 is forced into the borehole enough to press bearing plate 26 firmly into position. Bearing plate 26, which is fit around body 12, distributes the axial load of Split Set stabilizer 10 over a larger area of the surface and thereby contains surface sluffing.

Forcing Split Set stabilizer 10 into the borehole compresses body 12 along slit 20. The resilience provided by slit 20 allows body 12 to be compressed along its length, rather than crushed, as it is forced into the borehole. As a result, the resilient tendency of body 12 causes it to press tightly against the wall of the borehole as body 12 attempts to expand to its original shape. This creates friction between Split Set stabilizer 10 and the wall of the borehole along the length of body 12.

Figure 3:
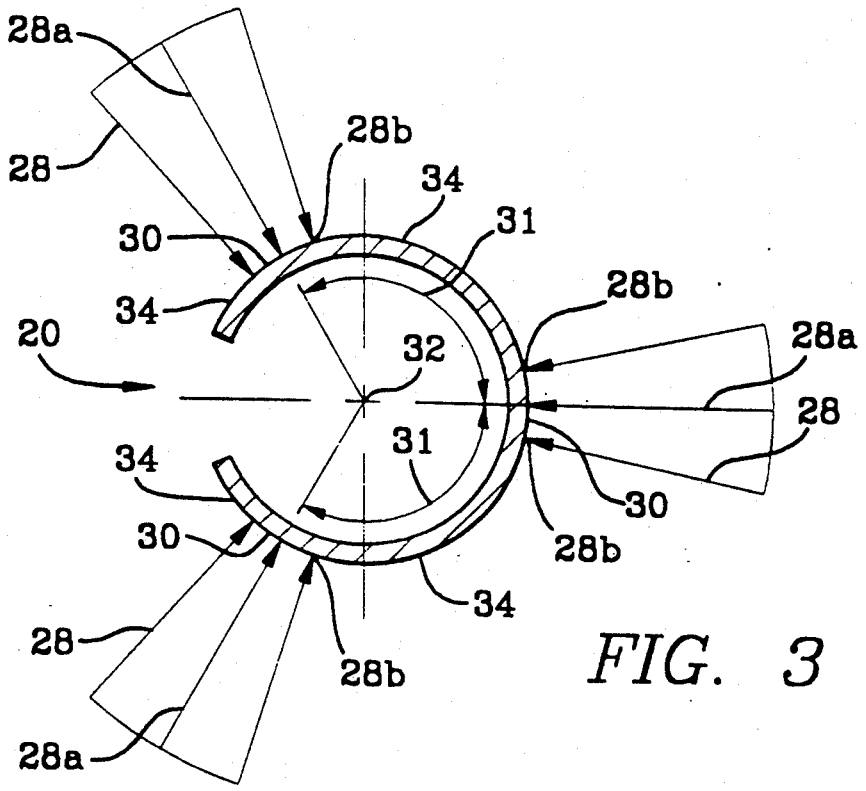
Figure 4:
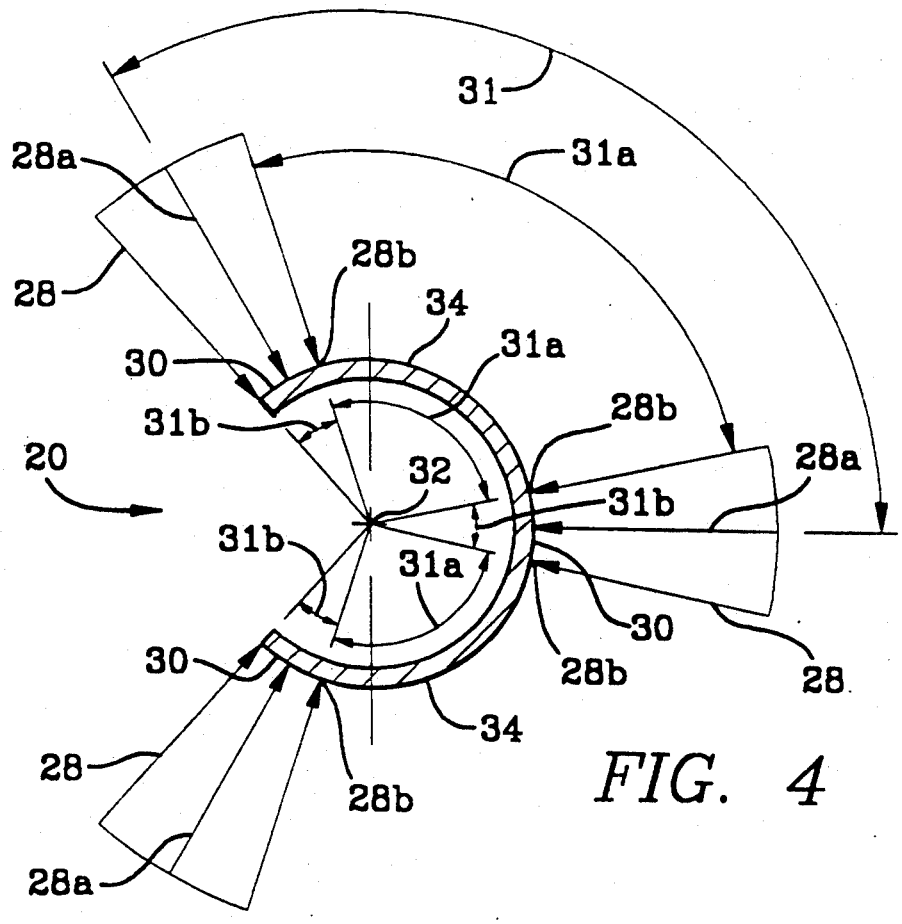
FIG. 4 is a cross sectional view of an installed open seam stabilizer of this invention, showing the points of friction with the borehole and portions of the body adjacent the slit having been removed.

As illustrated in FIGS. 3 and 4, by arrows 28, most of the friction and contact that occurs between shank 18 and the wall of the borehole is concentrated along a plurality of separate friction surfaces 30. The friction surface 30 that is spaced opposite slit 20 is also referred to herein by the term "backbone." The approximate centerlines **28*a* of friction surfaces 30 are spaced apart from each other preferably at an angle 31 of about 120 degrees, as measured in horizontal cross section around a center axis 32 of the borehole (not shown). As used herein, all angles are measured on an installed stabilizer 10, and are measured around the body 12 and not over the slit 20, between a backbone friction surface 30 and side friction surfaces on either side of the backbone. The approximate edges 28*b* of friction surfaces 30 are spaced apart from each other preferably at an angle 31*a* of about 100 degrees measured likewise. It should be understood that each friction surface 30 is arcuate, and extends over an arc bounded by a center angle 31*b* preferably of 20 degrees, as measured around a center axis 32 of the borehole, when viewed in horizontal cross section. The center angle 31***b* defining the arc length of friction surface 30 can vary a reasonable amount, preferably plus or minus 20 degrees. Thus, center angle 31*b* can vary between 0 degrees and 40 degrees. It should be understood, however, that when angle 31*b* is 0 degrees, friction surface 30 becomes a point contact, as viewed in cross section. Also, the center angle 31 spacing apart the centerlines 28*a* can vary, as described hereinafter, so long as the friction surfaces 30 are spaced apart far enough from the backbone to keep friction surfaces 30 in frictional contact with the borehole wall, so as to make stabilizer 10 self-sustaining in the borehole.

Between adjacent friction surfaces 30, the wall portions 34 of shank 18 are substantially in noncontact with the wall of the borehole. By substantially in noncontact, I mean that those wall portions of shank 18 are not frictionally engaged with the wall of the borehole, but incidental touching, due to borehole irregularities might occur. As a result of this nonfrictional, noncontact, there is no frictional holding advantage gained by having excess wall material adjacent slit 20, which is located between two friction surfaces 30. The present invention takes advantage of this by making slit 20 of sufficient width to extend entirely between two adjacent friction surfaces, as shown in FIG. 4. The portions of wall 34 spanning the sides of slit 20, as shown in FIG. 3, can be removed. This reduces the material required for manufacturing stabilizer 10 by 20 percent or more, without any loss in frictional holding power of the device because the portions of wall so removed 34, are those that are substantially noncontacting with the borehole wall.

Figure 5:
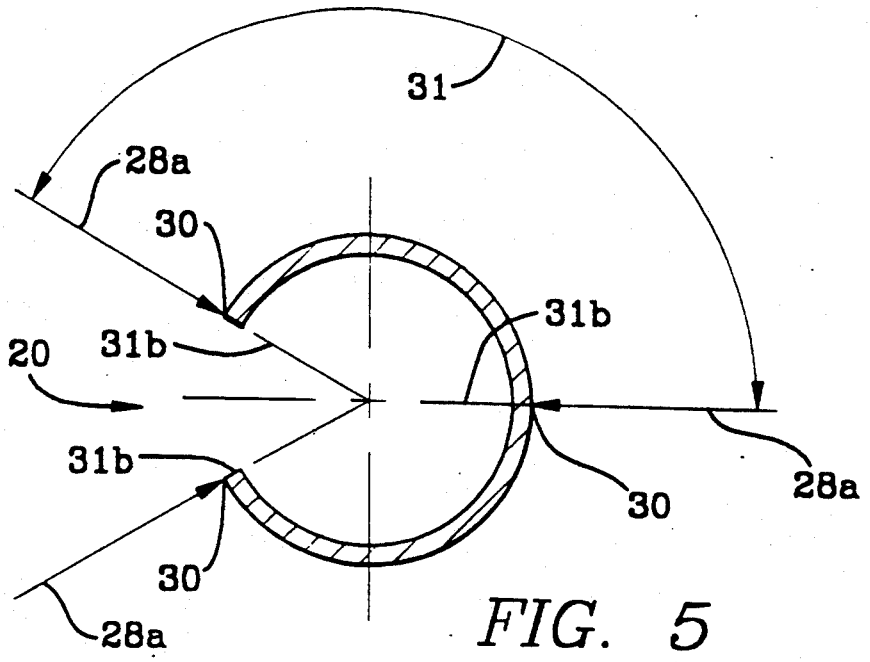
FIG. 5 is a cross sectional view of an installed open seam stabilizer of this invention showing one combination of friction surface location and friction surface width.

FIG. 5 shows one outer limit of the invention. Center angle 31*b* of friction surface 30 adjacent slit 20 is 0 degrees, making friction surface 30 a point contact, as described hereinabove. Thus, the distance between centerlines 28*a* of friction surfaces 30 as measured by angle 31 is 150 degrees.

Figure 6:
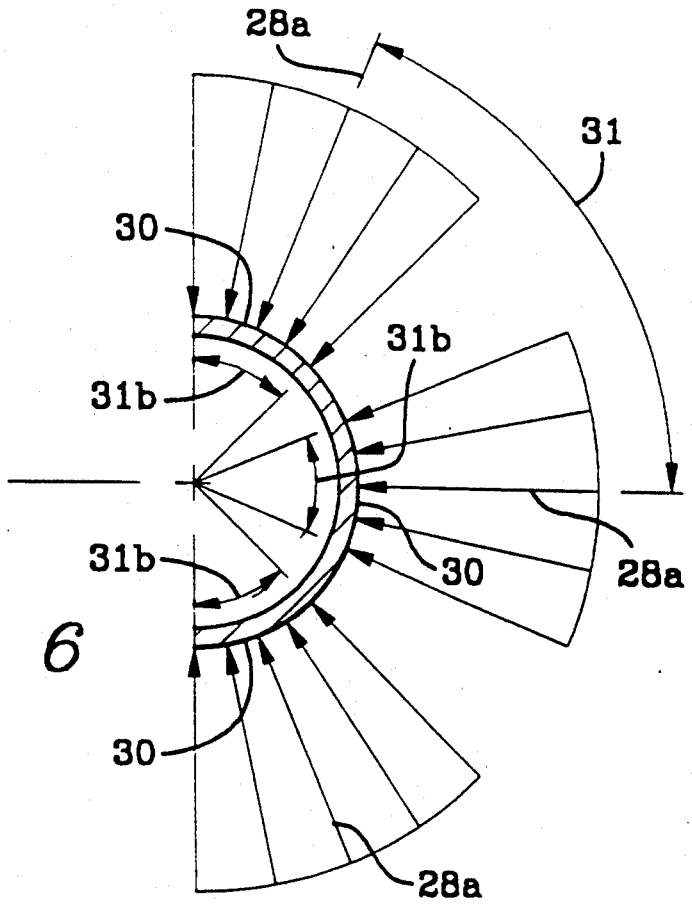
FIG. 6 is a cross sectional view of an installed open seam stabilizer of this invention showing an alternative combination of friction surface location and friction surface width.

FIG. 6 shows a second outer limit of the invention. Center angle 31*b* is 40 degrees for friction surface 30, making friction surface 30 a maximum width. The distance between centerlines 28 of friction surfaces 30, as measured by angle 31, is 70 degrees. This combination assures that the sum of center angle 31 and one-half of center angle 31*b* is at least 90 degrees, in order for the stabilizer to span the diameter of the borehole, to provide frictional contact between the installed stabilizer and the borehole wall. By "frictional contact" I mean load bearing contact, and not incidental touching due to variations of the stabilizer 10 or borehole wall. If the sum of center angles 31 and one-half of 31*b* is less than 90 degrees, the installed stabilizer will not span the diameter of the borehole and it will lack frictional contact with the borehole wall.

Thus, it can be understood that my invention includes any combination of center angle 31 between 70 and 150 degrees, with center angle 31*b* between 0 and 40 degrees, so long as the combination spans the diameter of the borehole to result in frictional contact between the friction surfaces 30 and the borehole wall. Also, center angles 31 and 31*b*, for a friction surface 30 on one side of the backbone, can be different from center angles 31 and 31*b*, respectively, for a friction surface 30 on an opposite side of the backbone, so long as the combination spans the diameter of the borehole.

Figure 7:
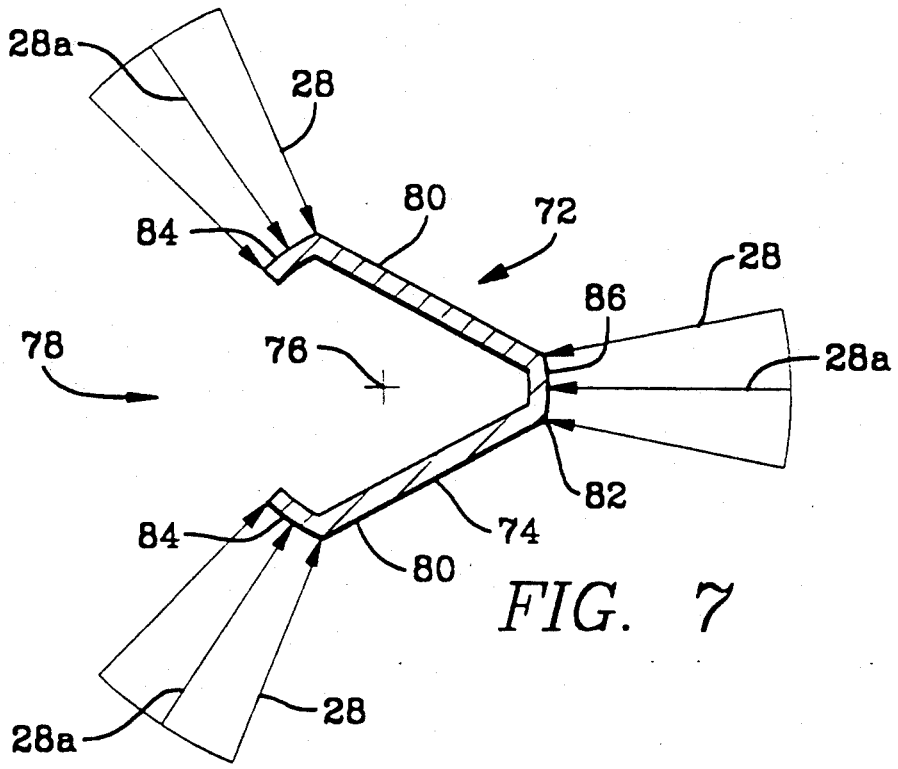
FIG. 7 is a cross sectional view of the body of an alternate embodiment of the invention.

Referring now to FIG. 7, another embodiment of the invention is shown. Stabilizer 72 has an open seamed, substantially equilateral triangular cross sectional body 74, which is V-form, when viewed in a plane that is transverse to, and perpendicular to the axis 76 of the borehole. Body 74 has a slit 78 extending along the length thereof, and a pair of arms 80 angularly joined at a backbone portion 82 opposite the slit 78. Arms 80 are extend in a substantially straight line, instead of in an arcuate line, as disclosed hereinabove for a cylindrical body 12. Arms 80 join at about a 120 degree angle, and are resiliently compressible inwardly in relation to each other, such compression occurring adjacent backbone 82. Arms 80 form arcuate friction surfaces 84 by terminating inwardly at an angle of about 120 degrees. Backbone 82 forms arcuate friction surface 86, which, along with friction surfaces 84, are spaced apart from each other at an angle of about 120 degrees, as measured in horizontal cross section around a center axis 76 of the borehole, as described hereinabove. The width of friction surfaces 84 and 86, as well as the angular relationships between the centerlines and edges of friction surfaces 84,86 are the same as described hereinabove for a cylindrical body, and need not be repeated here.

Friction surfaces 86 and 84 extend along the length of the shank portion of body 74. Wall portions of the shank between friction surfaces 84, 86 are substantially in noncontact with the wall of the borehole. Arms 80 can be thicker adjacent backbone portion 82 than adjacent friction surfaces 84. Because arms 80 are straight rather than arcuate, as in cylindrical bodies, less material is required to provide the stabilizer, resulting in savings of 30 per cent or more in materials cost, weight and shipping expenses, without substantial loss of friction holding performance. Not shown is a flange means fastened to the bottom end of the stabilizer, as described hereinabove.

It would be equivalent to provide a slight curvature to arms 80, and still achieve a savings by requiring less material. While I have described the tubular body of this invention as cylindrical or V-form in cross section, it would be equivalent to use other polygonal cross sections for the body.

I prefer to manufacture the invention from a suitable metal, such as steel, but it would be equivalent to provide the stabilizer 72 from a suitable plastic material with means on each friction surface for enhancing frictional contact with the borehole.

It should be understood that the angular measurements as used for this invention, refer to the invention as installed in a borehole, and in frictional contact therewith.

Having described the invention, what is claimed is:

1. A friction rock stabilizer for use in a substantially circular cross sectional borehole comprising:

a. an elongated hollow tubular body having a tapered top end, a bottom end and a shank portion therebetween; and b. compression means extending along the length of the body for permitting resilient compression of the body during insertion into an undersized borehole, and for resiliently urging a plurality of friction load bearing surfaces extending the length of said shank into frictional load bearing contact against the borehole wall, said friction load bearing surfaces, after said body is inserted into the borehole, being spaced apart from each other at an angle between 70 degrees and 150 degrees, as measured around a center axis of the borehole, said friction load bearing surfaces having therebetween wall portions of said shank that are substantially in noncontact with the wall of the borehole, said compression means comprising a slit extending along the length of the body, said slit, after said body is inserted into the borehole, having a width extending completely between two adjacent friction load bearing surfaces.

2. The invention of claim 1 wherein said bottom end includes a flange for supporting a plate thereon.

3. The invention of claim 2 wherein the body is cylindrical in cross section.

4. The invention of claim 1 wherein the friction load bearing surfaces have a width defined by an angle between 0 degrees and 40 degrees, as measured around a center axis of the bore hole.

5. The invention of claim 1 wherein the body is V-form in cross section, having pair of arms angularly joined at a backbone portion opposite the slit, said arms being resiliently compressible in relation to each other, each of said arms and said backbone terminating at a friction load bearing surface.

6. The invention of claim 5 in which each arm is thicker adjacent the backbone portion than adjacent the friction load bearing surface portion.

7. The invention of claim 5 in which the backbone and each friction load bearing surface has thereon means for enhancing the frictional load bearing contact with the borehole.

8. The invention of claim 7 wherein aid bottom end includes a flange for supporting a plate thereon.

9. The invention of claim 6 wherein said bottom end includes a flange for supporting a plate thereon.

10. A friction rock stabilizer for use in a substantially circular cross sectional borehole comprising:

a. an elongated hollow cylindrical tubular body having a tapered top end, a bottom end and a shank portion therebetween;

b. compression means extending along the length of the body for permitting resilient compression of the body during insertion into an undersized borehole, and for resiliently urging a plurality of friction load bearing surfaces extending the length of said shank into frictional load bearing contact against the borehole wall, said friction load bearing surfaces, after said body is inserted into the borehole, being spaced apart from each other at an angle between 70 degrees and 150 degrees, as measured around a center axis of the borehole, said friction load bearing surfaces having therebetween wall portions of said shank that are substantially in noncontact with the wall of the borehole; and c. said compression means comprising a slit extending along the body, said slit, after said body is inserted into the borehole, having a width extending completely between two adjacent friction load bearing surfaces.

11. A friction work stabilizer for use in a substantially circular cross sectional borehole comprising:

a. an elongated V-form tubular body having a tapered top end, a bottom end and a shank portion therebetween;

b. compression means extending along the length of the body for permitting resilient compression of the body during insertion into an undersized borehole, and for resiliently urging a plurality of friction load bearing surfaces extending the length of said shank into frictional load bearing contact against the borehole wall, said friction load bearing surfaces, after said body is inserted into the borehole, being spaced apart from each other at an angle between 70 degrees and 150 degrees, as measured around a center axis of the borehole, said friction load bearing surfaces having therebetween wall portions of said shank that are substantially in noncontact with the wall of the borehole;

c. said compression means comprising a slit extending along the body, said slit, after said body is inserted into the borehole, having a width extending completely between two adjacent friction load bearing surfaces; and d. said body having a pair of arms angularly joined at a backbone portion opposite the slit, said arms being resiliently compressible in relation to each other, each of said arms and said backbone terminating at a friction load bearing surface.

* * * * *